US008997605B2

(12) United States Patent
Fuller et al.

(10) Patent No.: US 8,997,605 B2
(45) Date of Patent: Apr. 7, 2015

(54) PEDAL ASSEMBLY WITH HEEL/LEG POINT CRASH SHOCK ABSORPTION

(71) Applicant: KSR Technologies Co., Ridgetown (CA)

(72) Inventors: Shaun Fuller, Ridgetown (CA); Dan O'Neill, Chatham (CA)

(73) Assignee: KSR IP Holdings LLC., Wilmington, DE (US)

( * ) Notice: Subject to any disclaimer, the term of this patent is extended or adjusted under 35 U.S.C. 154(b) by 107 days.

(21) Appl. No.: 13/803,366

(22) Filed: Mar. 14, 2013

(65) Prior Publication Data

US 2013/0305874 A1 Nov. 21, 2013

Related U.S. Application Data

(60) Provisional application No. 61/648,904, filed on May 18, 2012.

(51) Int. Cl.
*G05G 1/30* (2008.04)
*G05G 1/44* (2008.04)
*G05G 1/327* (2008.04)

(52) U.S. Cl.
CPC ..... *G05G 1/44* (2013.01); *Y10T 74/20534* (2015.01); *G05G 1/327* (2013.01)

(58) Field of Classification Search
USPC ..... 74/512, 513, 560; 180/274; 280/748
See application file for complete search history.

(56) References Cited

U.S. PATENT DOCUMENTS

| | | | | |
|---|---|---|---|---|
| 7,458,293 | B2 * | 12/2008 | Terradas et al. | 74/512 |
| 7,690,279 | B2 * | 4/2010 | Himetani | 74/512 |
| 7,946,192 | B2 * | 5/2011 | Kim et al. | 74/513 |
| 2009/0293666 | A1 | 12/2009 | Kim et al. | |
| 2010/0319480 | A1 * | 12/2010 | Nebuya et al. | 74/513 |

FOREIGN PATENT DOCUMENTS

| | | |
|---|---|---|
| WO | 02060731 | 8/2002 |

* cited by examiner

*Primary Examiner* — Vicky Johnson
(74) *Attorney, Agent, or Firm* — Gifford, Krass, Sprinkle, Anderson & Citkowski, P.C.

(57) ABSTRACT

A pedal assembly having crash absorption features. The pedal assembly includes a pedal arm having a lower end. A slider bracket is provided connected to the rear surface of the pedal arm. A slider mounted within the slider bracket is connected to a housing of the pedal assembly. The slider bracket includes at least one shear tab breakable by the slider. A crush block is provided mounted within the housing of the pedal assembly. The crush block is further connected to the pedal arm. An absorption block is provided mounted adjacent to and forward of the crush block. In the event of a front end crash, a forward force is applied on the pedal pad. As this happens, the slider moves downwards within the slider bracket thereby breaking the shear tabs and allowing further rotation of the pedal arm.

15 Claims, 8 Drawing Sheets

PEDAL ASSEMBLY WITH HEEL/LEG POINT CRASH SHOCK ABSORPTION

CROSS-REFERENCE TO RELATED APPLICATIONS

This application claims priority of U.S. Provisional Applications 61/648,904 and 61/648,968 filed May 18, 2012, the contents of which are included herein by reference.

FIELD OF THE INVENTION

This invention relates generally to pedal assemblies. More particularly, this invention relates to a pedal assembly having crash shock absorption capability.

BACKGROUND OF THE INVENTION

During a front end crash, the momentum of the vehicle will project the driver towards the front of the vehicle. This will force the driver's leg and heel point into the pedal pad with great force. Therefore, it would be desirable to produce a pedal assembly for an accelerator which absorbs the forward momentum of the driver's heel/leg point on the pedal pad.

SUMMARY OF THE INVENTION

The present invention provides for a pedal assembly having crash absorption features. The pedal assembly includes a pedal arm having a lower end. The pedal arm further including a front surface and a rear surface wherein the front surface includes a pedal pad. A slider bracket is provided connected to the rear surface of the pedal arm. A slider mounted within the slider bracket is connected to a housing of the pedal assembly. The slider bracket includes at least one shear tab breakable by the slider. The pedal arm is pivotally connected to the housing at the lower end of the pedal arm. A crush block is provided mounted within the housing of the pedal assembly. The crush block is further connected to the pedal arm. An absorption block is provided mounted adjacent to and forward of the crush block. In the event of a front end crash, a forward force is applied on the pedal pad. As this happens, the slider moves downwards within the slider bracket thereby breaking the shear tabs and allowing further rotation of the pedal arm. As the pedal rotates upward, the crush block slides in a forward direction towards the absorption block thereby crushing the absorption block and reducing the force as felt by the driver of the vehicle.

In the present invention, the absorption block is made of a honeycomb-like structure. The pedal arm is connected to the housing by means of a living hinge and pivotable about that living hinge. The slider is connected to the housing by means of an elongated rod and allowing the slider to pivot in relation to the housing on the elongated rod.

DETAILED DESCRIPTION OF THE INVENTION

Figure 1:
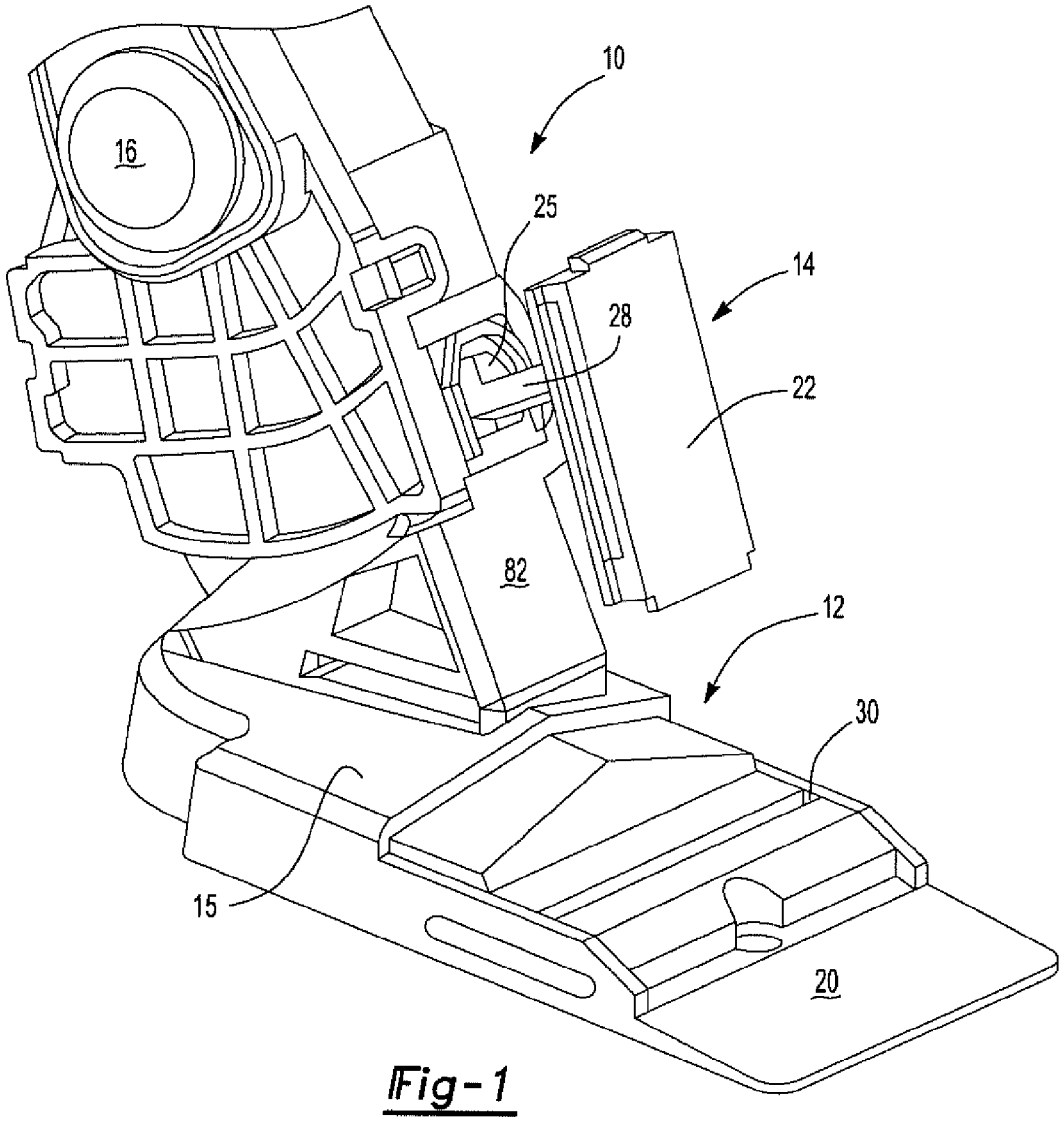
FIG. 1 illustrates a perspective view of the pedal assembly with the pedal arm removed.
Figure 3:
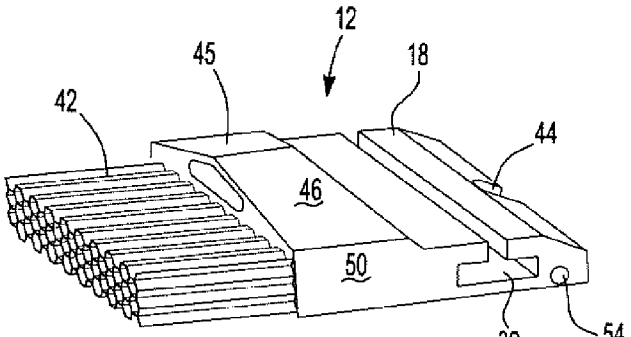
FIG. 3 illustrates a perspective view of the crush assembly.

The pedal assembly of the present invention provides for improved crash absorption features. The pedal assembly is a fly by wire, organ pedal style, accelerator pedal assembly. The pedal assembly includes a pedal pad attached to a housing by a hinge or living hinge mounted to a crush block. The pedal arm is connected by a push rod to a lever arm which is rotated to create a signal for position sensing and force feedback to the driver. The push rod is connected to the pedal arm by a pivot slider. During a crash, the crush block deforms an energy absorbing element allowing the mounting point to move in a forward direction and the pivot slider breaks tabs to slide down the casing to permit the pedal arm to return to an idle position.

The pedal assembly 10 includes a crush assembly and a slider assembly. The pedal assembly 10 further includes various electronic controls 16 and a housing 15. The crush assembly 12 is mounted into a lower portion of the housing 15. The crush assembly includes a crush block 18 and an absorption block 42. The crush block 18 includes a generally T-shaped slot operable to accept a portion of the living hinge of a pedal arm. The crush block 18 further includes connection portions 44 allowing for easy assembly.

The absorption block 42 of the present invention is made of any material allowing for easy deformation. In the present embodiment, the absorption block 42 is made of a honeycomb-like material 48. In the present embodiment, the honeycomb-like material 48 is made of a metal material shaped in the form of a honeycomb structure. In alternative embodiments, the absorption block 42 and the honeycomb-like structure 48 is made of a plastic or plastic-like material allowing for absorption and crushing.

The crush block 18 further includes an upper surface 46. The generally T-shaped slot 30 is formed from the upper surface 46. The crush block 18 further includes a side surface 50 operable to rest adjacent to an inner surface 52 of the housing 15. The crush block 18 further includes a protrusion 54 operable to connect with the slot 56 of the housing 15. The protrusion 54 connects with the slot 56 to ensure alignment during a forward sliding movement of the crush block towards the absorption block during a front end crash.

The crush assembly 12 including the absorption block 42 and the crush block 18 are mounted within the housing 15. The housing 15 includes an open portion 17 operable to hold the absorption block 42 and the crush block 18.

A pedal arm 34 is provided mounted to the crush block 18. The pedal arm 34 includes a lower end 31 having a living hinge 32. The living hinge 32 is operable to connect with and mount within the T-shaped slot 30 provided on the crush block 18. Once the living hinge 32 is mounted within the T-shaped slot 30, the pedal arm 34 is free to pivot about the living hinge 32.

The pedal arm 34 further includes a front surface 36 and a rear surface 38. The front surface 36 includes a pedal pad 40. The pedal arm 34 is generally rectangular and elongated extending away from the living hinge 32.

Figure 2:
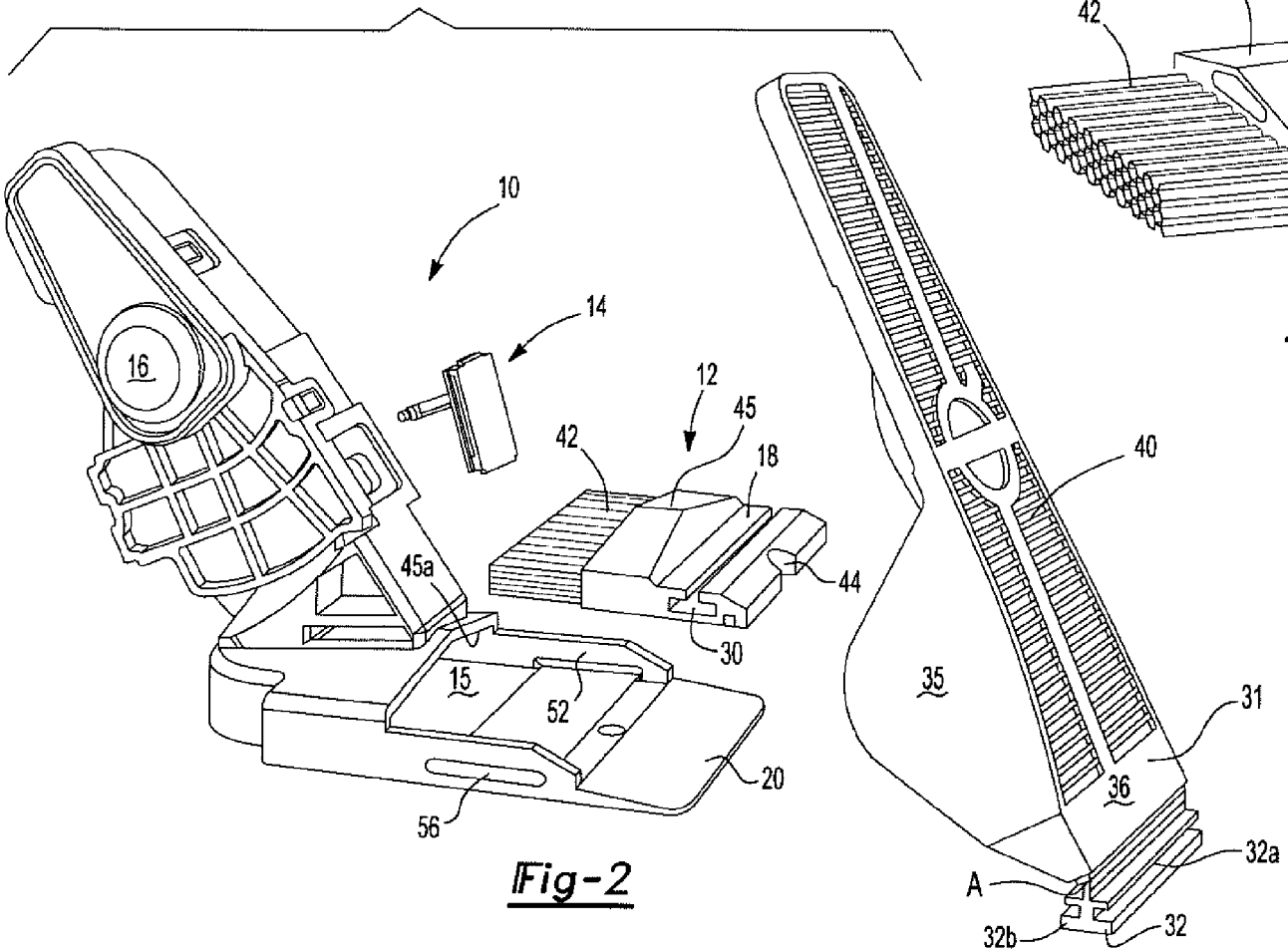
FIG. 2 illustrates an exploded perspective view of the pedal assembly.
Figure 4:
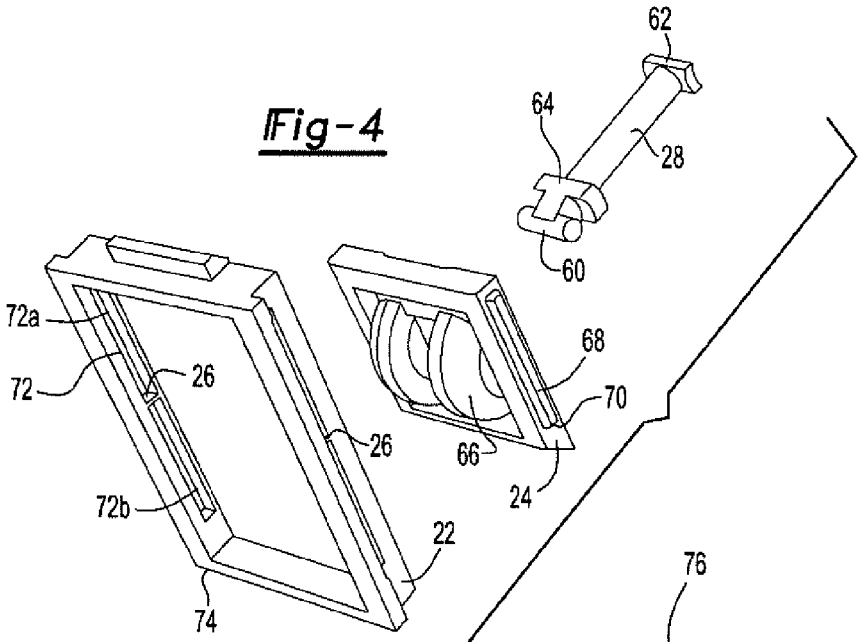
FIG. 4 illustrates an exploded view of the slider assembly.
Figure 5:
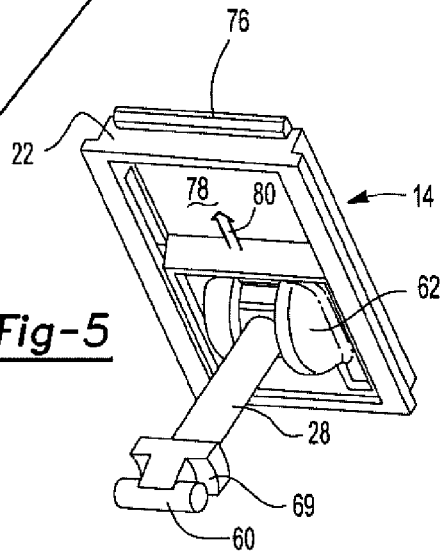
FIG. 5 illustrates a perspective view of the slider assembly.
Figure 6:
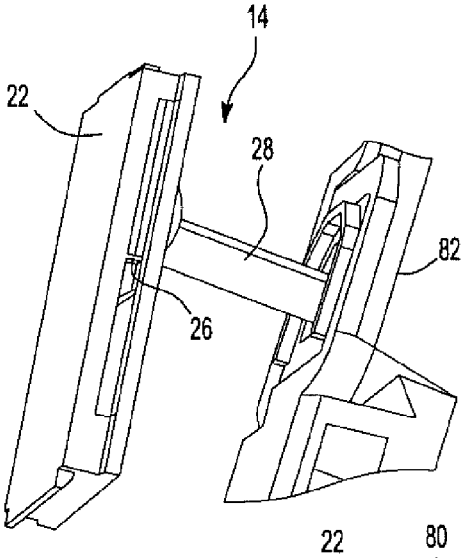
FIG. 6 illustrates a perspective view of the slider assembly in an installed position.

The pedal arm 34 includes an elongated top surface, the front surface 36, adapted to receive a foot of a driver. The pedal arm 34 further includes a pair of spaced apart wings 35 extending forwardly extending on either side of the housing 15. The lower end 31 of the pedal arm 34 is mounted to the crush block 18. The living hinge 32 includes a flexible portion extending between a pair of T-shaped flanges 32*a*, 32*b*. As shown in FIG. 2, the T-shaped flanges 32*a*, 32*b* of the living hinge 32 are slid into the T-shaped slot 30 of the crush block 18.

The crush block 18 is formed with a molded material such as polypropylene or nylon reinforced with glass fiber. The crush block 18 is in abutment with the absorption block 42. In the present embodiment, the honeycomb-like structure 48 is aligned such that the cells are traverse to the axis of the vehicle. In other embodiments, the honeycomb-like structure is opposite.

The crush block 18 has an upward extending portion 45 having an upper surface 46. The upper portion 45 is in abutment with the wall of the housing 15. The upper portion 45 will deform under pressure. The honeycomb is mounted so that when force is applied to the rear end of the crush block, the crush block 18 will move forward collapsing the honeycomb-like structure 48 of the absorption block 42 and move a hinge point A forwardly.

The housing 15 includes an upper portion 82. The upper portion 82 of the housing 14 includes a cavity 25 in which a lever arm 28 is mounted. The lever arm 28 includes a hub 60, 64 at the pivot end of the rod 28. The hub 60 includes a plate 64 which is the rotor for a noncontacting position sensor. Transmitting coils of the position sensor are mounted along the pivot axis of the lever or rod 28 on the housing 15 or on the upper housing 82. The noncontacting position sensor may be of any type, but in the preferred embodiment is an acceptable position sensor manufactured by the assignee of this application.

The push rod 28 extends between the hub 60 and a slider 24. The slider 24 and a slider bracket 26 are formed of a molded material. The rod 28 further includes an opposed end 64 operable to connect to the slider 24.

The slider bracket 22 includes a slot 72 and a shear tab 26. The slot 72 is elongated on at least one wall of the slider bracket 22. The slider bracket 22 is generally rectangular having four opposed walls. The slot 72 extending along at least one wall of the slider bracket 22 is elongated. The shear tab 26 is disposed at a midpoint along the slot 72. The slider 22 further includes a rear wall 74. The slider bracket 22 connects to the rear surface 38 of the pedal arm 34. The rear surface 74 of the slider bracket 22 connects to the rear surface 38 of the pedal arm 34.

The slider 24 is mounted within the slider bracket 22. The slider bracket includes various connection features 66. The slider 24 further includes a pair of elongated protrusions 68 extending along an outer wall of the slider 24. The slider 24 is generally square or rectangular having four opposed walls. The elongated protrusion 68 is adapted to fit within the slot 72 of the slider bracket 22. The elongated protrusions 68 include an abutment surface 70 operable to contact the shear tabs 26 in the event of a crash. Before a crash, the elongated protrusions 68 rest within the slots 72. In the event of a crash, the protrusions 68 in the slider 24 and the abutment surface 70 of the protrusions 68 forcibly breaks the shear tab 26 allowing the slider 24 to travel along the slot 72 allowing the slider to move downwards. This movement is shown in FIG. 7, which is an upside-down view of the slider assembly 14, for which movement arrow 80 illustrates movement of the slider 24 within the slider bracket 22 thereby forcibly breaking the shear tabs 26.

Figure 7:
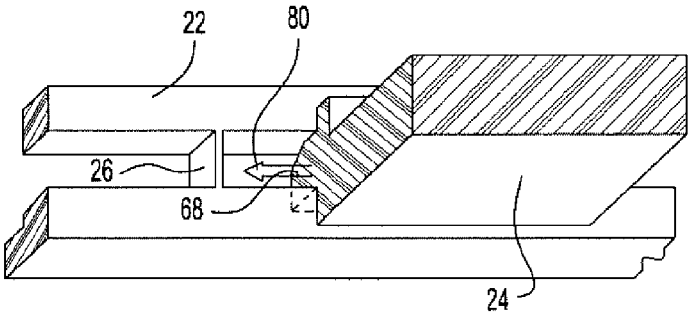
FIG. 7 illustrates a close up cross-sectional perspective view of the slider moving towards the shear tab.
Figure 8A:
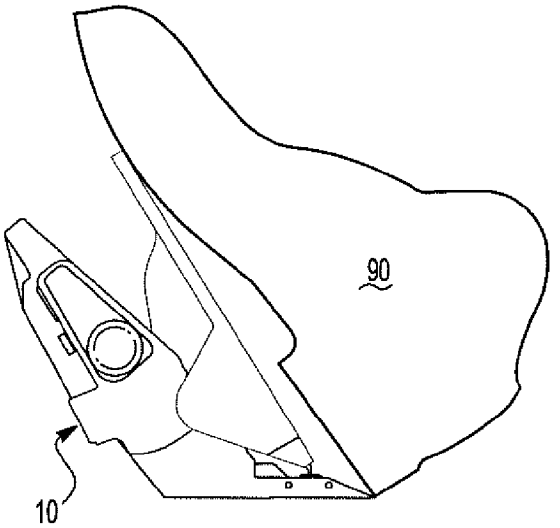
FIG. 8A illustrates the pedal assembly in an idle position.
Figure 8B:
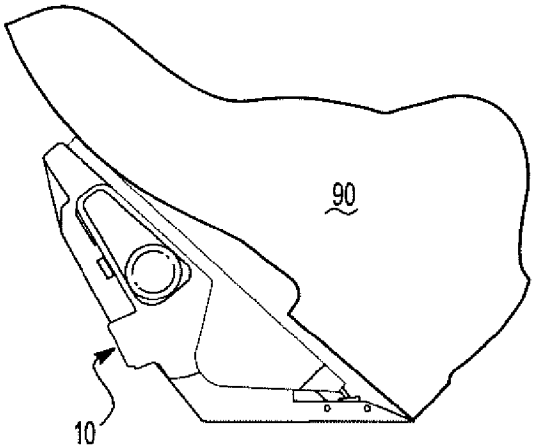
FIG. 8B illustrates the pedal assembly in a wide open throttle position.
Figure 8C:
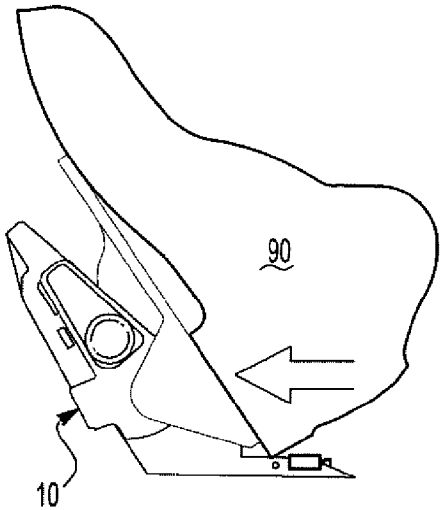
FIG. 8C illustrates the pedal assembly in a crash situation.
Figure 9:
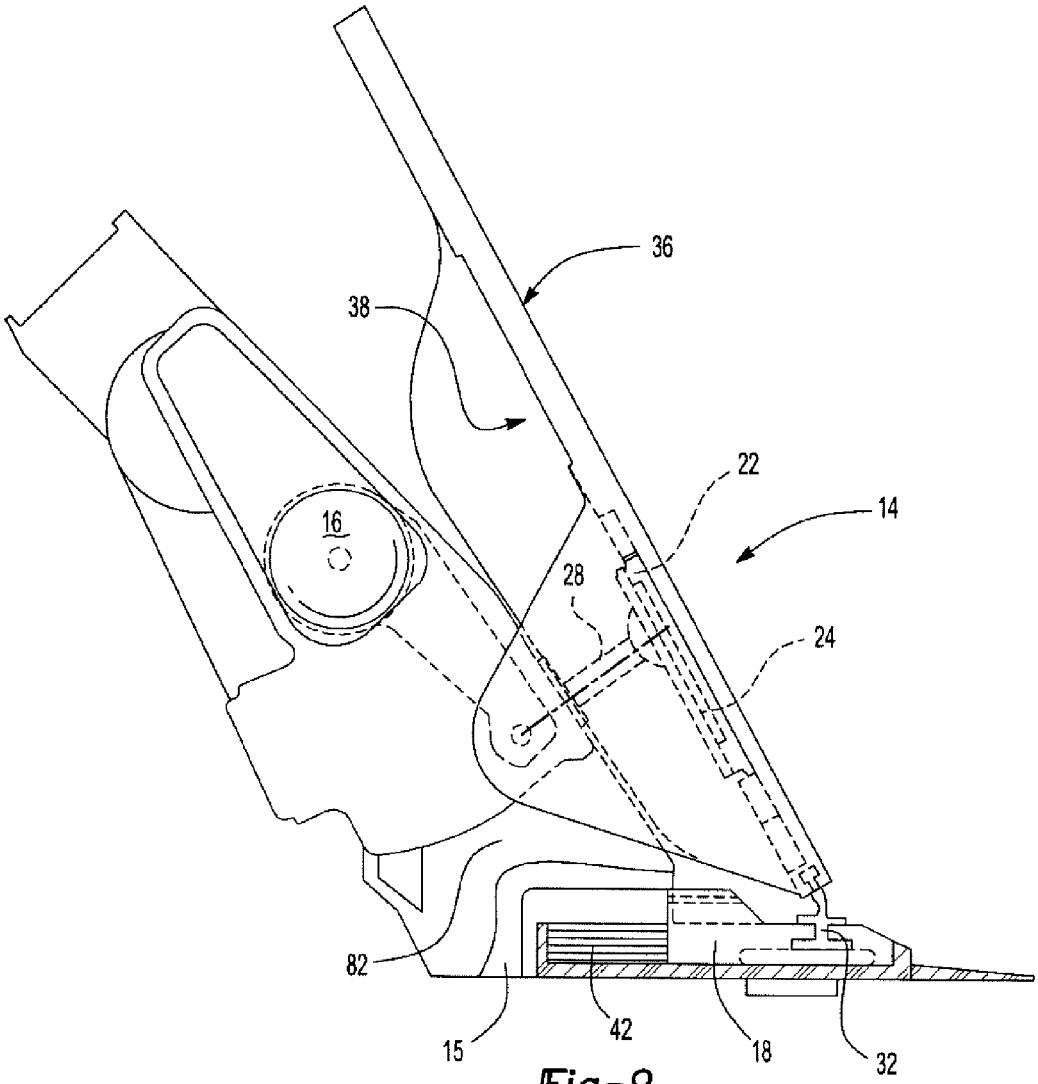
FIG. 9 illustrates a side view of the pedal assembly of the present invention.
Figure 10:
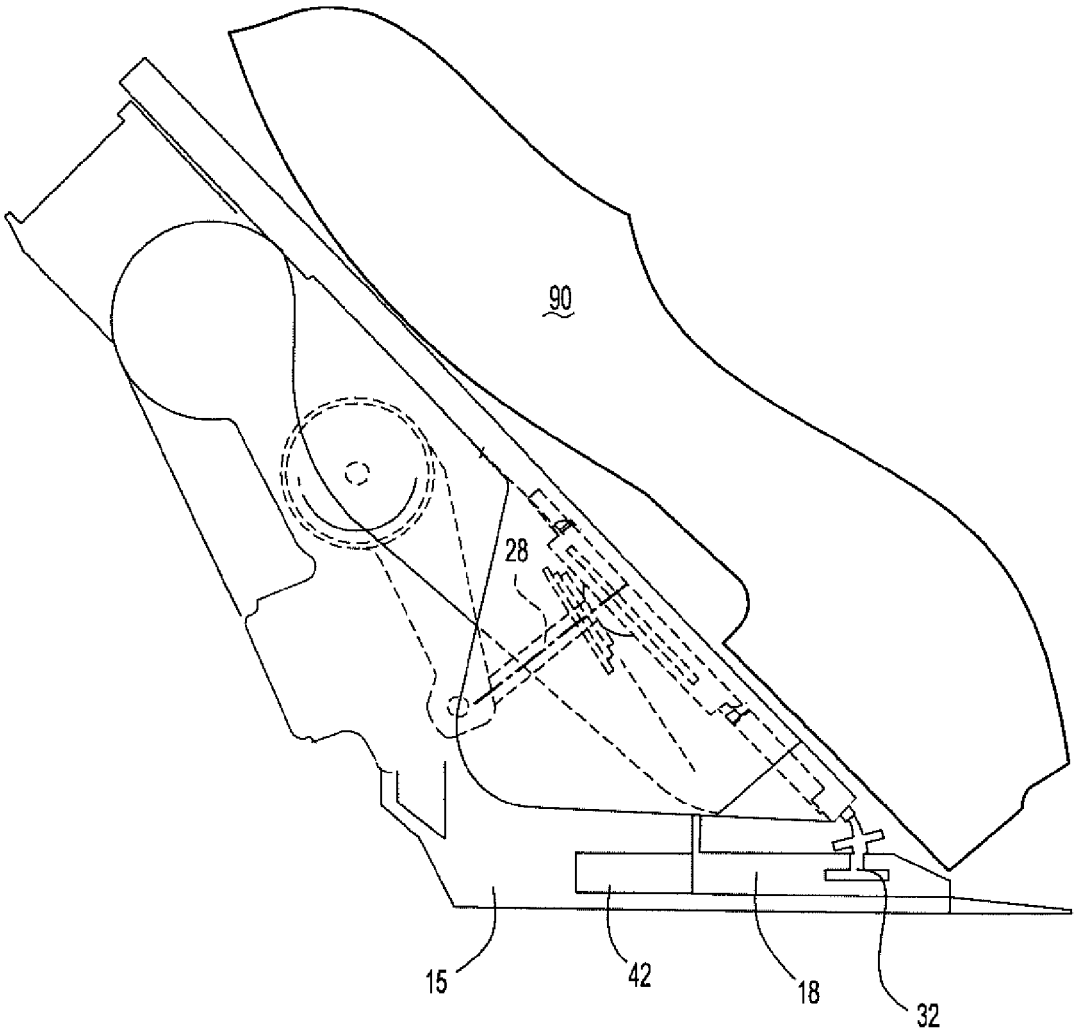
FIG. 10 illustrates a side view of the pedal assembly of the present invention in a wide open throttle position.

Movement of the slider 24 to break the shear tab 26 is further shown in FIG. 7. FIG. 7 illustrates the movement arrow 80 forcibly moving the slider 24 towards the shear tab 26. The protrusion 68 of the slider 24 contacts the shear tab 26 of the slider bracket 22. Upon contact of the protrusion 68 and the abutment surface 70 of the slider 24, the shear tab 26 breaks thereby allowing for the pivot point A to move in a forward position allowing the crush block 18 to crush the absorption block 42.

The slider 24 is snapped within the slider bracket 22. The slider bracket 22 may also be considered a carrier. The slider 24 is held in the upper end 72*a* of the slot 72 by the pair of shear tabs 26. The deformation of the break of the shear tabs 26 permits the crush block 18 to move forward, the upper portion of the crush block is guided along a channel 45*a* formed in the housing 15 ahead of a breakaway wall.

Figure 12:
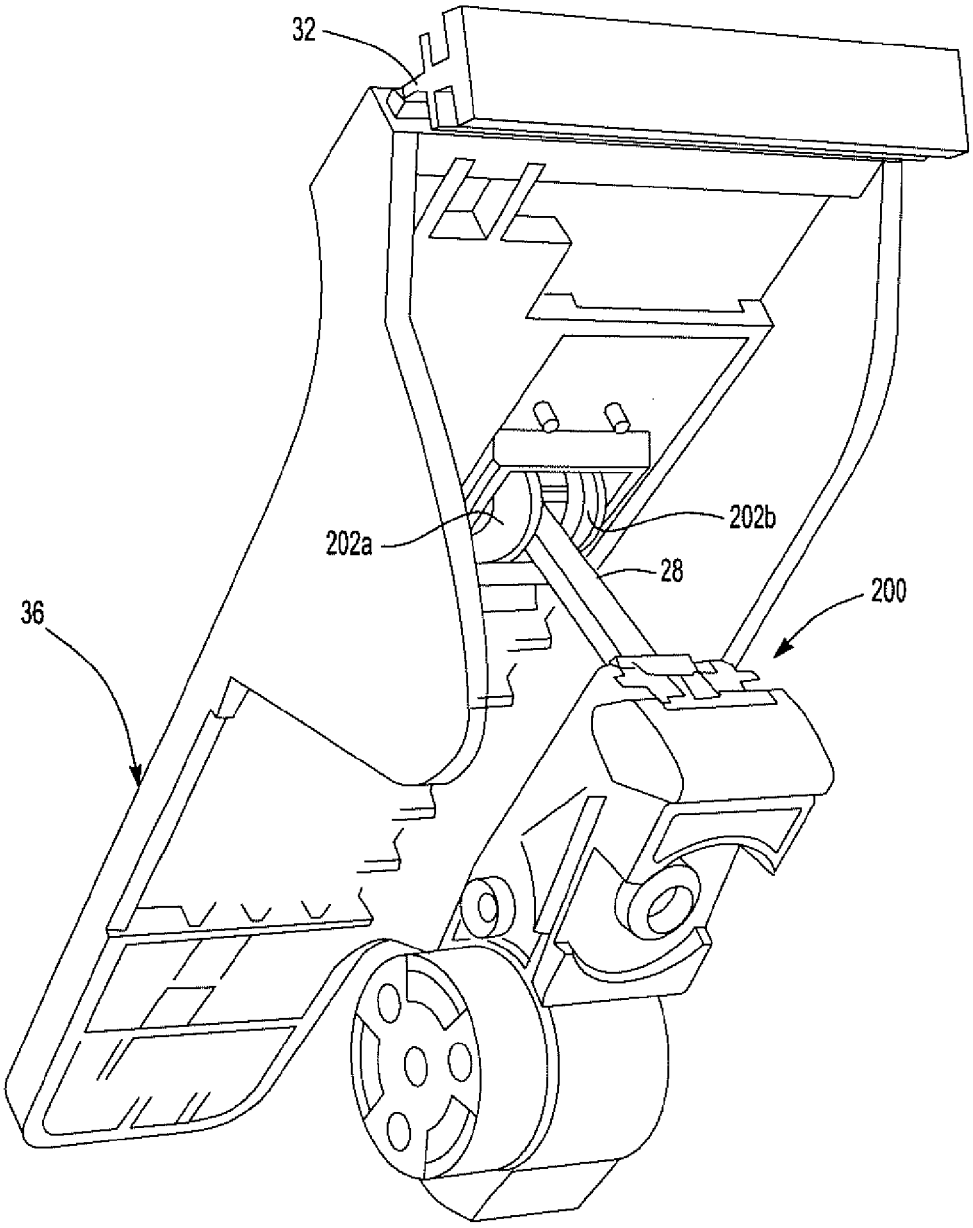
FIG. 12 illustrates the spring carrier of the present invention.

FIG. 12 illustrates a spring carrier 200 is mounted to the rod 28. The spring carrier 200 includes a pair of arms 202*a*, 202*b* to permit the rod to pivot with respect to the pedal arm 34 and allowing it to maintain its alignment when the rod 28 is moved. The spring is compressed by movement of the rod against an inner wall of the housing to produce a biasing force feedback to the driver. A friction shoe is further mounted to the end of the rod 28. The friction shoe is forced against a curved or cam-shaped wall within the housing 15 by the spring carrier to produce hysteresis.

Figure 11:
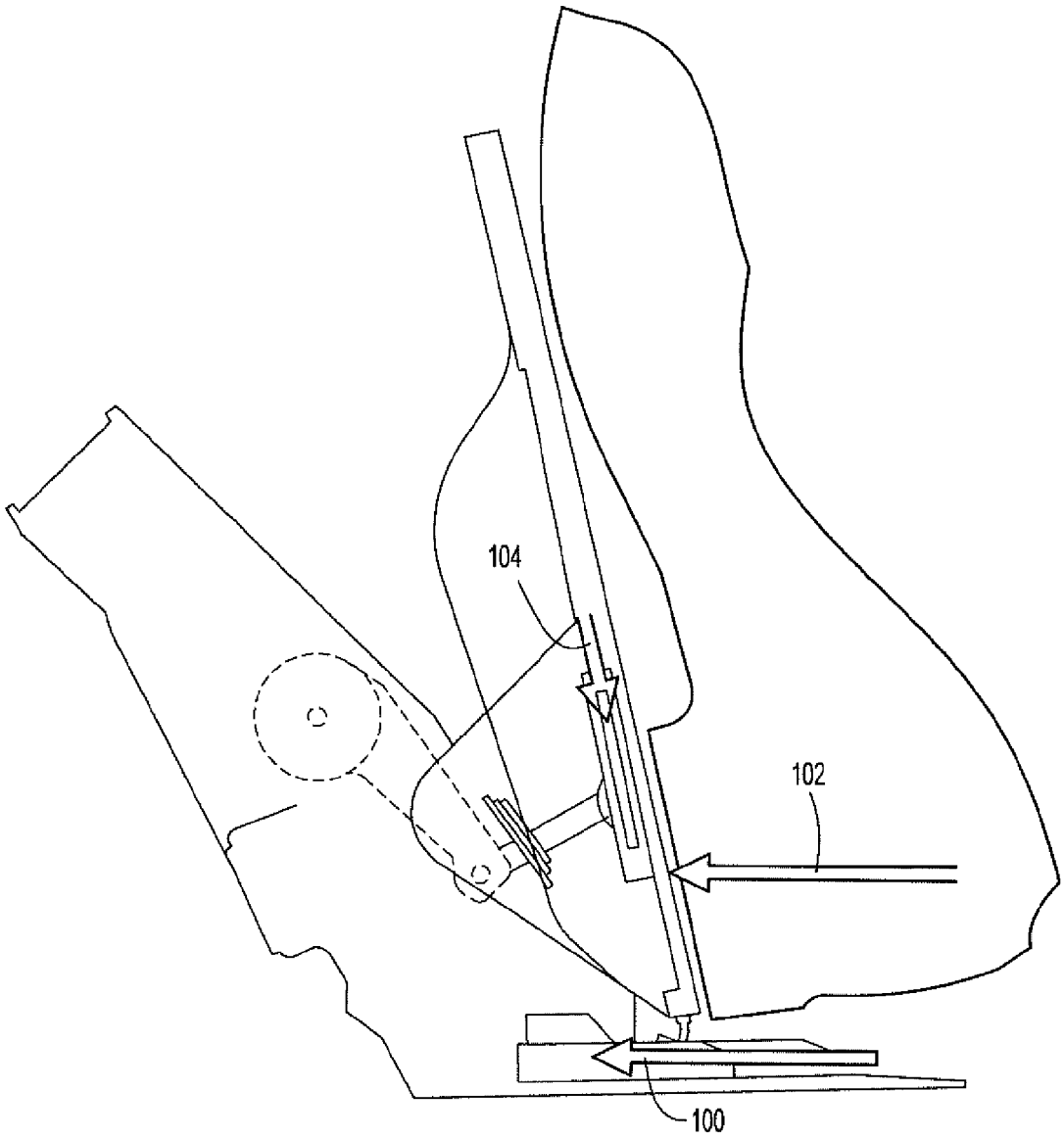
FIG. 11 illustrates the pedal assembly of the present invention in a crash position.

FIGS. 8A, 8B, 8C, and 9-11 illustrate movement of the pedal and its features during operation and crash situations. During normal operation of the pedal assembly 10, the slider 24 is held in position by means of the shear tabs 26. The crush block 18 maintains the lower portion of the pedal arm 34 and hinge in a fixed location. Depression of the pedal arm 34 moves the rod 28 to depress the end of the lever, rotating the hub of the lever and generating a signal in the position sensor and to depress the hysteresis spring. When a crash occurs and the pedal is anywhere off an idle position, the momentum of the vehicle will project the driver towards the front of the vehicle. This will force the leg, heel point into the pedal pad 40 with great force. This force will drive the crush block 18 forward, crushing the absorption block 42 and absorbing the force that would normally be sent up the driver's leg. As the pedal pad 40 is being driven forward, the shear tabs 26 on the slider housing 22 will break away and permit the slider 24 to move down the track or slots 72 of the slider housing 22. This operation allows for the full amount of crush of the honeycomb-like structure 48 of the absorption block 42 and also allows the pedal arm to return to an idle position. FIG. 11 illustrates the momentum 102 on the pedal pad 40 to generate a forward movement of the crush block 18 as shown by the movement arrow 100. The slider 24 then breaks the shear tabs 26 and the slider 24 moves down along the slider bracket 22 as shown by movement arrow 104.

The invention is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the appended claims.

The invention claimed is:

1. A pedal assembly having crash absorption features, the pedal assembly comprising:

a pedal arm having a lower end, the pedal arm having a pedal pad, the pedal arm having a first pivot point;

a housing, a crush block mounted to the housing, the crush block further in communication with the first pivot point of the pedal arm;

an absorption block mounted adjacent to the crush block, the absorption block adapted to collapse under pressure from the crush block;

the crush block sliding towards and crushing the absorption block to absorb forward momentum of a driver in the event of a front end crash, the crush block being a separate piece from the absorption block.

2. The pedal assembly of claim 1 wherein the pedal arm includes a front surface and a rear surface.

3. The pedal assembly of claim 2 wherein a slider bracket is connected to the rear surface of the pedal arm, the slider bracket having at least one shear tab.

4. The pedal assembly of claim 3 wherein a slider is mounted within the slider bracket.

5. The pedal assembly of claim 4 wherein the slider is connected to the housing by means of an elongated rod.

6. The pedal assembly of claim 5 wherein the elongated rod is pivotally mounted to the housing.

7. The pedal assembly of claim 4 wherein the slider includes protrusion operable to break the shear tabs of the slider bracket upon a forward momentum of a driver.

8. The pedal assembly of claim 1 wherein the absorption block is a honeycomb-like structure.

9. The pedal assembly of claim 1 wherein the pedal arm is mounted to the housing by means of a living hinge.

10. A pedal assembly having crash absorption features, the pedal assembly comprising:

a pedal arm having a lower end, a pivot point located at the lower end of the pedal arm, the pedal arm having a front surface and a rear surface, the front surface having a pedal pad;

a slider bracket connected to the rear surface of the pedal arm, a slider mounted within the slider bracket, the slider bracket having at least one shear tab breakable by the slider;

a housing, the slider connected to the housing, the pedal arm pivotally mounted to the housing at the lower end of the pedal arm;

a crush block mounted within the housing, the crush block in communication with the pivot point of the pedal arm, the absorption block adapted to permanently deform under pressure from the crush block;

an absorption block mounted adjacent to the crush block, the shear tab breaking, the slider traveling downwards, the crush block sliding towards and crushing the absorption block to absorb forward momentum of a driver in the event of a front end crash.

11. The pedal assembly of claim 10 wherein the absorption block is a honeycomb-like structure.

12. The pedal assembly of claim 10 wherein the pedal arm is mounted to the housing by means of a living hinge.

13. The pedal assembly of claim 10 wherein the slider bracket is connected to the housing by means of an elongated rod.

14. The pedal assembly of claim 13 wherein the elongated rod is pivotally mounted to the housing.

15. A pedal assembly having crash absorption features, the pedal assembly comprising:

a pedal arm having a lower end, the pedal arm having a pedal pad, the pedal arm having a first pivot point;

a housing, a crush block mounted to the housing, the crush block further in communication with the first pivot point of the pedal arm;

an absorption block mounted adjacent to the crush block, the absorption block having a honeycomb structure;

the crush block sliding towards and crushing the absorption block to absorb forward momentum of a driver in the event of a front end crash.

* * * * *